United States Patent [19]

Hines

[11] Patent Number: 4,538,746

[45] Date of Patent: Sep. 3, 1985

[54] KEG-TAPPING ASSEMBLY

[75] Inventor: James H. Hines, Glenwood, N.J.

[73] Assignee: Vending Components, Inc., Hackensack, N.J.

[21] Appl. No.: 508,930

[22] Filed: Jun. 29, 1983

[51] Int. Cl.[3] ..... B65D 83/00

[52] U.S. Cl. ..... 222/153; 222/400.7; 137/322; 251/89.5

[58] Field of Search ..... 222/400.7, 400.8, 153; 137/316, 320, 322; 251/149.9, 89.5

[56] References Cited

U.S. PATENT DOCUMENTS 4,291,821 9/1981 Nezworski ..... 222/400.7

4,305,421 12/1981 Fallon ..... 222/400.7

*Primary Examiner*—Joseph J. Rolla

*Assistant Examiner*—Kenneth Noland

*Attorney, Agent, or Firm*—Hopgood, Calimafde, Kalil, Blaustein & Judlowe

[57] ABSTRACT

The invention contemplates improved safety interlock mechanism incorporated in a keg-tapping assembly which is removably attachable to a standard beer keg or the like, via a bayonet-type engagement between lugs on the keg and a slotted flange on the keg-tapping assembly. The keg-tapping assembly is of the variety in which a handle is depressed to gain beverage-dispensing access to the keg and in which the handle is raised to close the keg and to shut off supply of gas pressure to the keg. A guide formed in the keg-tapping assembly locates a vertically displaceable locking leg, having articulated connection to the handle, such that in a downward actuation of the handle, the guided locking leg will be in a position to deny lug displacement into or through one of the slots of the slotted flange, before handle displacement can either begin to open the keg or to admit gas pressure thereto. The result is that unless the handle is sufficiently raised to allow safe removal of the keg-tapping assembly from a keg, the keg-tapping assembly cannot be removed.

5 Claims, 5 Drawing Figures

KEG-TAPPING ASSEMBLY

BACKGROUND OF THE INVENTION

The invention relates to a keg-tapping assembly, for adapting a keg for the safe pressurized dispensing of beverage contents.

Kegs for delivery of beer or other beverage to taverns and restaurants are typically equipped with a so-called Barnes neck to which a draft tube is fitted, with a normally closed check valve at the upper end of the tube. The bartender is presented with the cylindrically annular configuration of the thus-fitted neck, the same being characterized by diametrically opposed inward lugs which have removable bayonet-locking engagement with a standardized base-flange configuration of slot formations, via which a keg-tapping assembly is removably assembled, with axially downward and clockwise rotary displacement in the course of establishing the bayonet connection of the keg-tapping assembly to the keg neck.

Such a keg-tapping assembly has a body with provision for receiving a supply of gas for pressurized delivery of dispensed beverage. Within the body a tubular valve member is guided for vertical displaceability; it can be actuated via down-up crank displacement of an external handle. When bayonet-fitted in tapping relation with a keg, a down displacement of the handle drives the draft-tube check valve to open position and admits pressurized discharge of dispensed beverage. In a customary tavern arrangement, the key-tapping assembly is hose-connected to a spigot which is convenient to the bartender, who controls all dispensing from the spigot.

A safety problem arises if the bartender tries to remove his keg-tapping assembly from an exhausted keg to a loaded new keg. If he has failed to raise the handle in order to vent pressure in the exhausted keg (and in order to shut off delivery of pressurized gas), there may be sufficient pressure in the keg to blast the assembly out of his hand, with resulting personal injury and property damage, not to mention unwanted discharge of some small unconsumed volume of beverage which remained in the keg.

U.S. Pat. No. 4,291,821 recognizes such a problem and seeks to solve it by providing a downward abutment which is rigid with the handle and which is intended to provide an interlock function, foreclosing handle actuation of the draft-tube check valve if the bayonet engagement is not complete. This patented device is also intended to foreclose disengagement of the bayonet lock if the handle has not been raised.

In spite of the improvement realized through said U.S. Pat. No. 4,291,821, it is found that the downward abutment of the handle can painfully foul the bartender's fingers, and there is still no clear differentiation between gas and/or beverage discharge and the bayonet-locked and unlocked condition.

BRIEF STATEMENT OF THE INVENTION

It is an object of the invention to provide improved safety interlock structure of the character indicated, whereby a keg-tapping assembly may be selectively applied to or removed from a keg, without danger of personal injury, and without risk of gas-pressure discharge or beverage discharge in the course of effecting such a change.

The invention achieves this object by providing a vertical guide formation on the body of the keg-tapping assembly, in substantial angular register with one of the bayonet-locking slots. An elongate interlock leg is limited by the guide to essentially vertical displaceability, and an articulating connection between the handle and the interlock leg is capable of placing the leg in the bayonet slot for the down position of the handle, thus foreclosing removal of the keg-tapping assembly as long as the handle is in its full-down position. Such removal is also foreclosed for all partially elevated positions of the handle, unless and until gas-pressure delivery has been terminated, with relief of keg-gas pressure. In the course of mounting a keg-tapping assembly to a new keg, the handle cannot be actuated sufficiently in the down direction to admit gas pressure to the keg, or to open the draft-tube check valve, unless and until the bayonet-lug engagement has sufficiently advanced to clear the involved bayonet-slot opening.

DETAILED DESCRIPTION

The invention will be described in detail for a preferred embodiment in conjunction with the accompanying drawings, in which.

Figure 1:
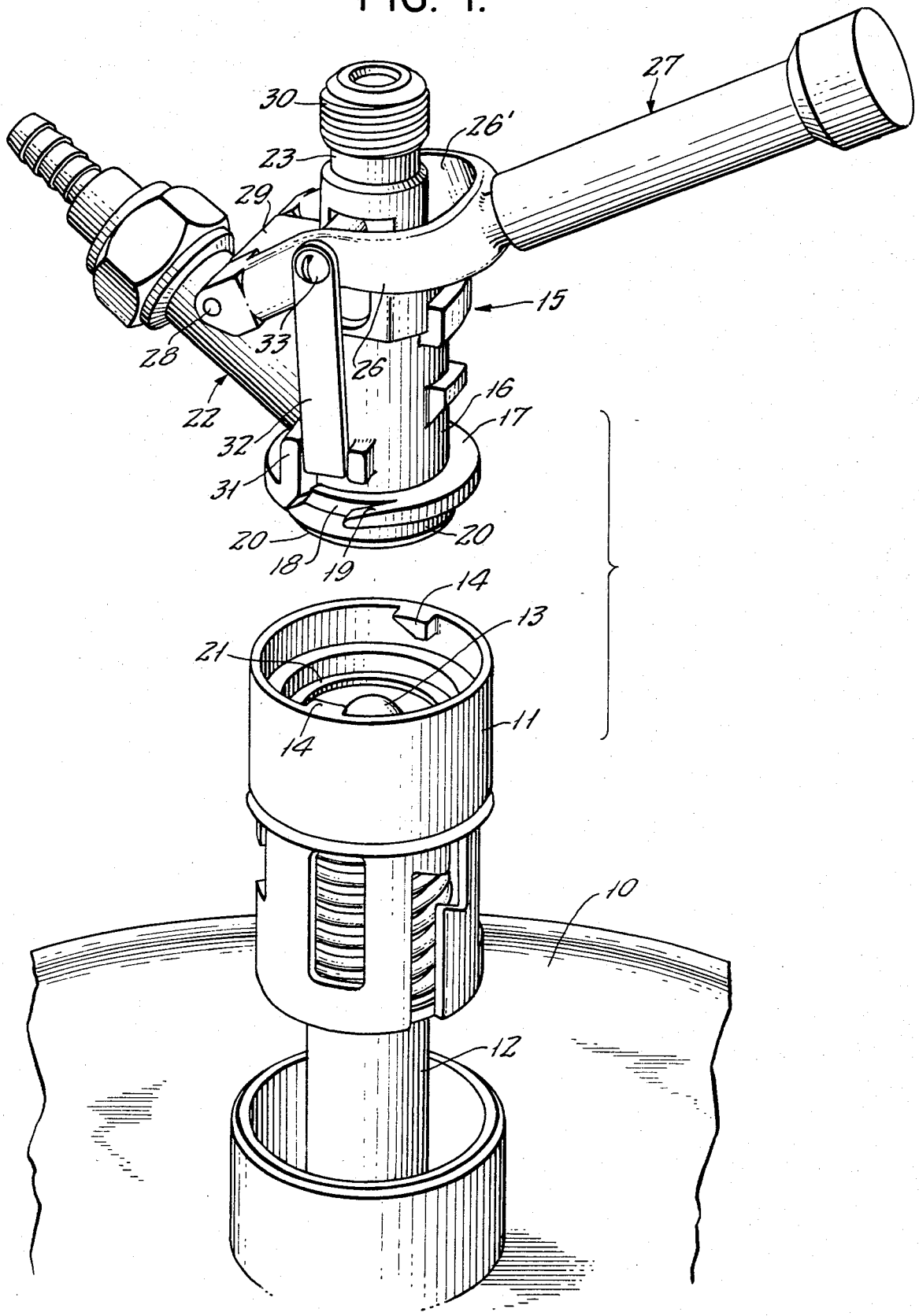
FIG. 1 is a simplified view in perspective, to show a keg-tapping assembly of the invention in exploded relation to, and in readines for assembly to, the fitted neck of a beverage keg, the actuating handle thereof being in its raised position.

Referring initially to FIG. 1, the invention is shown in application to the tapping of a keg 10 containing a beverage such as beer, and having a so-called Barnes neck 11 which has been fitted with a draft-tube unit 12. At its upper end, tube 12 includes a check valve in the form of a ball 13 which is upwardly and centrally exposed within the neck opening, and which is normally urged by spring means (not shown) in the up direction of check-valve closing. Reference is made to Cerrato U.S. Pat. No. 4,363,336 for a more complete discussion of such draft-tube structure, and it suffices here to identify a pair of radially inward diametrically opposed bayonet lugs 14.

Poised above the fitted neck 11 and in readiness for bayonet-locking removable assembly thereto is a keg-tapping assembly or unit 15 which may internally be as more fully described in Cerrato U.S. Pat. No. 4,341,240. It suffices to state that the keg-tapping unit 15 comprises a body 16 having a through passage and therefore generally annular and upstanding, when assembled to neck 11. Body 16 is characterized by a radially outward base flange 17 having bayonet-slot formations 18, for axially inserted reception of lugs 14 and for locked retention therewith upon partial clockwise rotation of unit 15 with respect to neck 11. In the course of such partial rotation, lugs 14 ride up local ramps, as at 19, to assure axially compressed annular seal action via an elastomeric base ring 20 of unit 15 and that flat annular area 21 around check valve 13 in the cupped upper end of the draft-tube unit 12.

Figure 2:
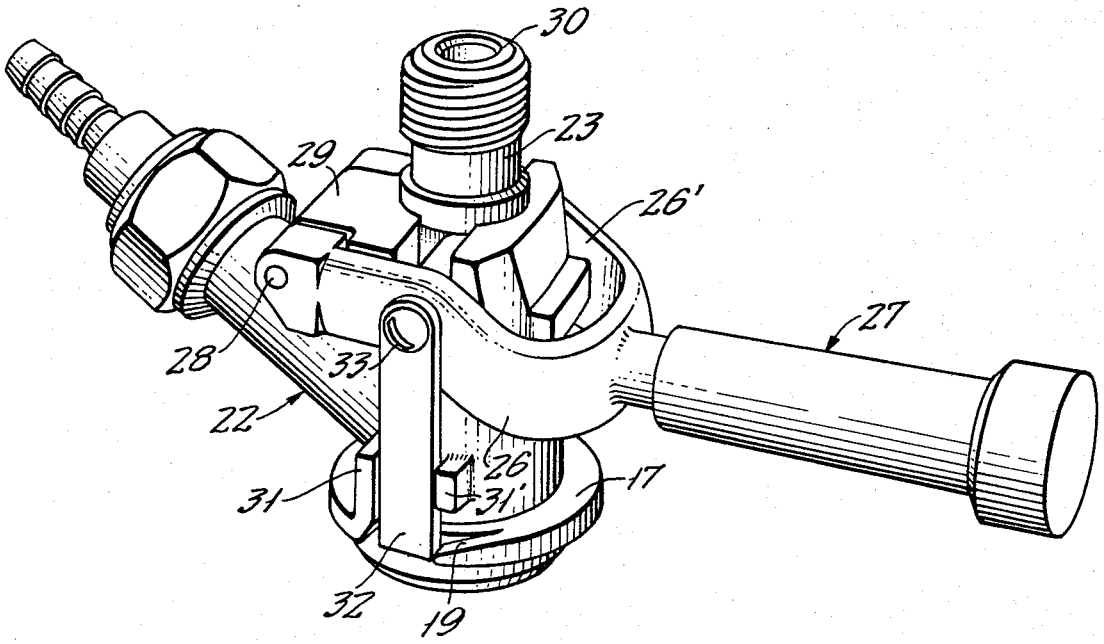
FIG. 2 is another perspective view of the keg-tapping assembly of FIG. 1, for down position of the handle.

The keg-tapping unit 15 has a side-port formation 22 for acceptance of a gas-pressure supply, to be used for gas-driven delivery of beverage. A tubular valve member 23 is guided for vertical displacement in body 16. Member 23 is characterized by diametrically opposed transverse grooves, as at 24, whereby opposed stud formations 25–25′ on the bifurcation arms 26–26′ of a pivoted handle 27 may control the up-down position of valve member 23, in accordance with the up-down position of handle 27. The pivot axis of handle 27 is provided by a removable horizontal pin 28 at transverse offset from the axis of valve member 23. The bifurcated end of handle 27 straddles body 16, and pin 28 derives body reference for both arms 26–26′ of handle 27 via an offset formation 29 of body 16. Preferably, the transverse offset of the handle-pivot axis from the valve-member axis is the same as the offset of stud formations 25–25′ from the pivot axis, and preferably also, the geometric plane which includes the pivot axis and the axes of stud formations 25–25′ is substantially normal to the valve-member axis, when handle 27 is in its down position (FIG. 2).

The lower end of the valve member 23 will be understood to have engaged and depressed the ball-check valve member 13 in the course of downward actuation of handle 27 (after unit 15 has been bayonet-engaged to the fitted neck 11). Also in the course of this downward movement, valve member 23 will be understood to have opened the gas-pressure port for admission of driving gas to the inner volume of the keg. Beverage will then be delivered out the threaded uper end 30 of valve member 23, subject to such control as may have been effected by a spigot connection (not shown) to the valve-member end 30.

In accordance with the invention, vertical-guide means 31 in vertical register with one of the bayonet slots 18 in flange 17 is a fixed part of body 16, and a locking leg, bar or rod 32 is guided by means 31, with articulating connection at 33 with handle 27; in the form shown, the articulating connection is afforded by a bolt which pivotally connects leg 32 to arm 26, at substantially the same offset from pin 28 as for the valve-member actuating stud 25. Preferably, in the down position of handle 27 (FIG. 2), leg 32 is vertical and is well within slot 18, with its bottom edge substantially at the bottom radial plane of flange 17. Preferably also, in the raised position of handle 27 (FIG. 1), the lower end of leg 32 sufficiently clears the upper radial plane of flange 17 to permit one of the lugs 14 to enter or leave (via slot 18) its bayonet-engaged position of support on flange 17; and throughout the course of handle (27) movement, the lower end of leg 32 remains guided by means 31.

Figure 3:
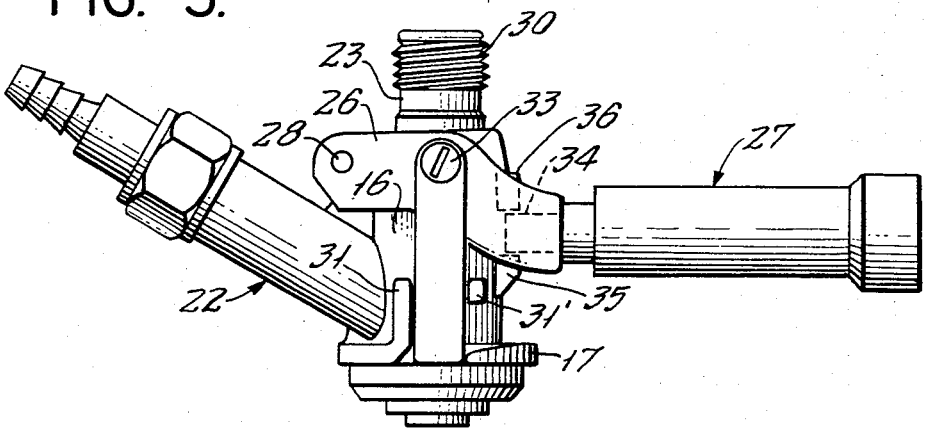
FIGS. 3 and 4 are simplified views in side elevation and partial section, to illustrate safety relationships of the invention.
Figure 4:
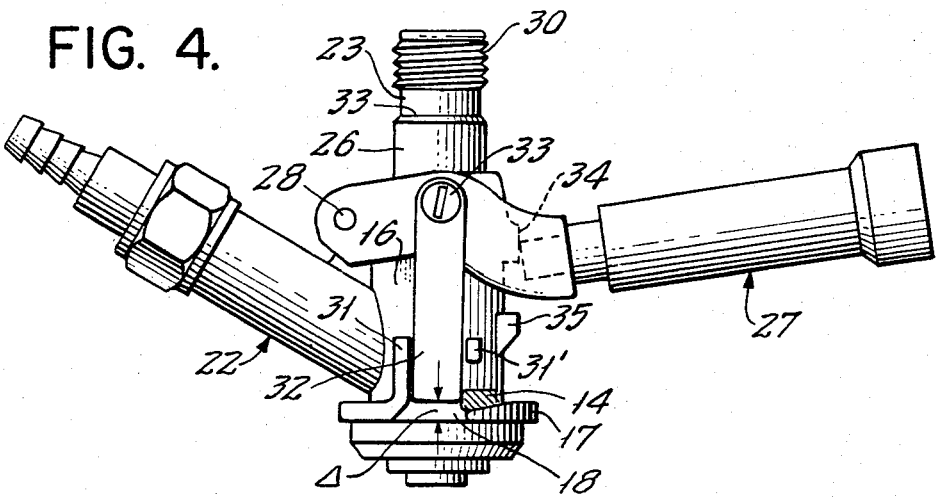
Figure 5:
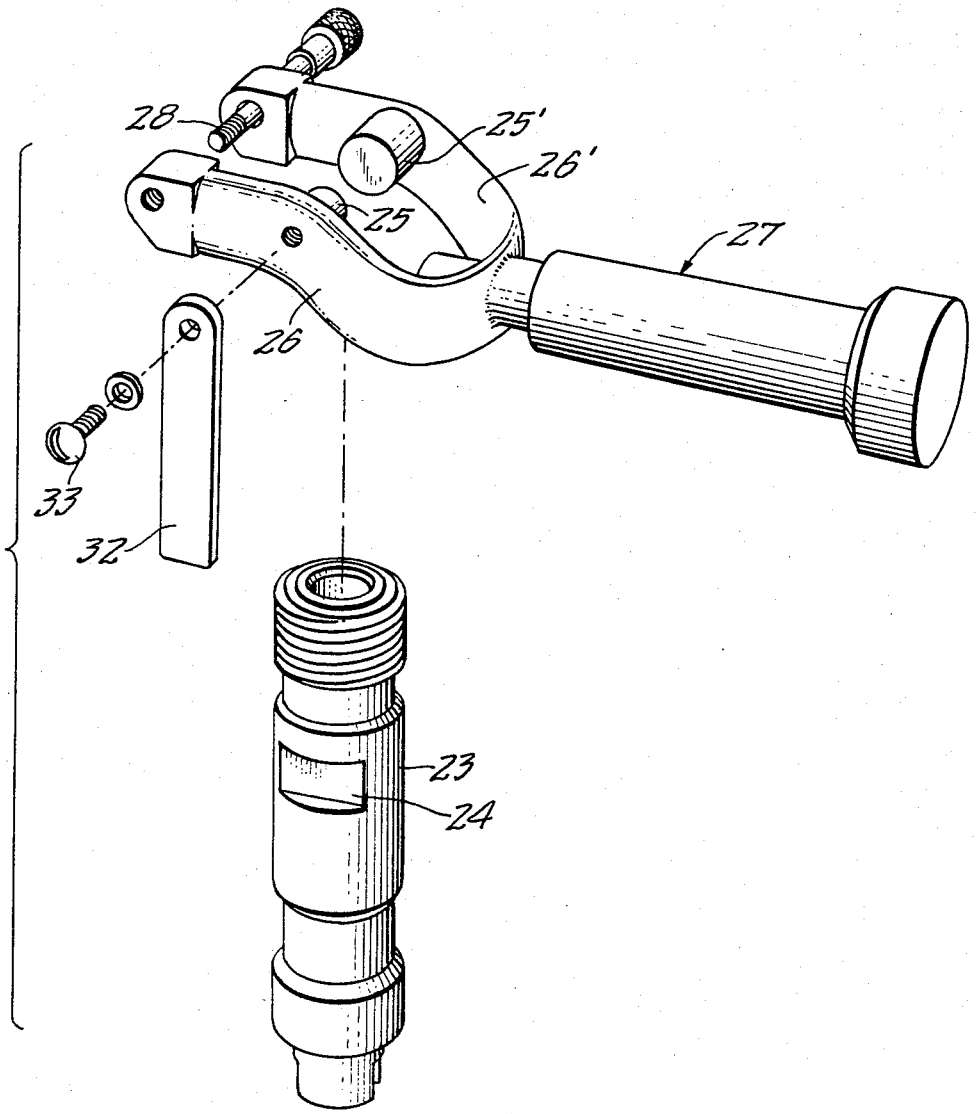
FIG. 5 is an exploded view in perspective to illustrate a feature of coaction between two of the component parts of the assembly of FIGS. 1 and 2.

Referring now more particularly to FIG. 3 and 4, it will be seen in FIG. 3 that in the down position of handle 27, leg 32 so occupies slot 31 that it is impossible to admit a lug 14 via slot 18, thus precluding any attaching or detaching of unit 15 as long as handle 27 is in its down position. FIG. 4 illustrates the further preferred relationship, namely, the extent to which handle 27 may be depressed before it so engages check valve 13 as to commence opening the same. In this position, the bottom end of leg 32 is offset from its lowest possible position, to the extent Δ, which extent approximates the thickness of flange 17; it is only with downward displacement Δ that the check valve 13 can be opened. It is thus clear that an engaged lug 14 (cross-hatched in FIG. 4) cannot leave via slot 18, as long as handle 27 is in its FIG. 4 position or lower (i.e., as long as handle 27 has been able to crack open check valve 13 to any extent whatsoever.

The described construction will be seen to have achieved the stated object. There is no possibility for accidental discharge of gas or beverage in the course of changing the tapping unit 15 from one keg to another. Also, the fact that leg 32 remains captive within guide means 31 assures against accidental injury of fingers. The guide means 31 may assure various forms, but as shown, it comprises a first lug 31 integrally cast with body 16 and with flange 17 thereof, plus a second lug 31′ at angular offset from lug 31 and at axial offset above flange 17, to at least an extent to permit lug (14) entry, as long as such entry is not foreclosed by downward actuation of handle 27. Preferably, for the axial extent to which lug 31 laps leg 32 in FIG. 4, lug 31 and leg 32 are parallel to the axis of body 16, thus providing an extensive abutment, independent of reaction upon handle 27 (or of reaction upon the articulating connection 33), for foreclosure of lug (14) passage through slot 18. This relation is positively retained, for the down position of handle 27, in that a locking dog 34 on handle 27 engages between vertically spaced abutments 35–36 on body 16, when in the down position; to raise handle 27, dog 34 is retracted against a spring (not shown) within handle 27, to permit clearance with respect to abutment 36, in the course of upward displacement of handle 27.

While the invention has been described in detail, it will be understood that modifications may be made without departing from the scope of the invention.

What is claimed is:

1. In a keg-tapping assembly for adapting a keg for the safe pressurized dispensing of beverage contents, wherein the keg has an annular neck with inwardly directed bayonet-locking lug formations and a central check-valve member resiliently upwardly loaded to closed position and exposed via said neck for downward valve-opening actuation, and wherein the tapping comprises an upstanding annular body with outwardly directed bayonet-slot formations in a flange at its lower end engageable with keg-neck lugs, whereby in the bayonent-engaged position of said keg-tapping assembly when mounted in said neck, said flange is fully axially recessed in and circumferentially enveloped by said neck, said body having a gas-pressure inlet port, a tubular valve member guided by and within said body, said valve member at its lower end when downwardly actuated permitting the check valve member to open and the valve member at its upper end permitting beverage contents to pass therethrough, and a valve-actuating handle pivoted to said body and connected for selective up-down actuation to determine (1) an opening of said check-valve member and admission of pressurized gas to the keg when said body is fitted to the keg neck and the handle is in its down position, and (2) cut-off of pressurized-gas delivery and relief from check-valve-actuating engagement when the handle is in its up position, the improvement in which said body includes an upwardly oriented guide formation at vertical offset from and in substantial angular register with one of said slot formations, and a vertically oriented rigid locking leg of substantially the width of said one slot formation and vertically displaceable in said guide formation, an articulating pin connection between said leg and a part of said handle, said leg (3) in the down position of said handle being positioned to substantially occupy said one slot formation and to foreclose disengagement of said bayonet formations and (4) in the up position of said handle being positioned to clear the path of bayonet-lug displacement, and (5) said leg being of sufficient downward extent to interfere with the involved keg-neck lug in the event that bayonet-locking rotation of said body with respect to the keg neck has been insufficient for the lug to clear the involved slot formation, the point of such interference being prior to any opening actuation of the check valve, whereby the lower end of said locking leg is at least in partial axial overlap with said neck for all valve-opening conditions, however slight or full the extent of valve opening.

2. The improvement of claim 1, in which said handle is bifurcated at its pivoted end, the arms of the bifurcation straddling said body and the pivot axis of handle connection to said body being horizontal and at radial offset from the axis of tubular valve-member displaceability, said articulating connection being a pinned connection of said locking leg to said handle at substantially said radial offset from the handle-pivot axis.

3. The improvement of claim 1, in which said handle is bifurcated at its pivoted end, the arms of the bifurcation straddling said body and the pivot axis of handle connection to said body being horizontal and at radial offset from the axis of tubular valve-member displaceability, said tubular valve member having parallel transverse grooves of different axial extent on one compared to the other side of the tubular valve-member axis, and first and second lugs of different size carried by the bifurcated arms of said handle and respectively sized for engagement with said grooves only when the handle has been correctly oriented in its pivoted connection to said body, said lugs being at substantially said radial offset from the handle-pivot axis.

4. The improvement of claim 1, in which at least one wall of said guide formation is continuous to one edge of one slot formation and is substantially parallel to the axis of tubular valve-member displaceability.

5. The improvement of claim 4, in which said locking leg is adjacent and substantially on the alignment of said one wall when said handle is in its down position.

* * * * *